US006694113B2

(12) United States Patent
Park et al.

(10) Patent No.: US 6,694,113 B2
(45) Date of Patent: Feb. 17, 2004

(54) INK DELIVERY SYSTEM AND INK DELIVERY METHOD OF LIQUID -TYPE ELECTROPHOTOGRAPHIC PRINTER

(75) Inventors: Geun-yong Park, Suwon-si (KR); Hyun-seong Shin, Suwon-si (KR); Hyong-gu Lee, Suwon-si (KR); Yong-su Kim, Suwon-si (KR); Woo-chul Jung, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 37 days.

(21) Appl. No.: 10/060,286

(22) Filed: Feb. 1, 2002

(65) Prior Publication Data

US 2002/0114637 A1 Aug. 22, 2002

(30) Foreign Application Priority Data

Feb. 3, 2001 (KR) ..... 2001-5257

(51) Int. Cl.[7] ..... G03G 15/10
(52) U.S. Cl. ..... 399/57; 399/58
(58) Field of Search ..... 399/57, 58, 59, 399/61, 62, 233, 237, 250, 251

(56) References Cited

U.S. PATENT DOCUMENTS 5,442,427 A * 8/1995 Day ..... 399/237
5,926,668 A * 7/1999 Lee ..... 399/57
5,983,046 A * 11/1999 Lee ..... 399/57

* cited by examiner

*Primary Examiner*—Hoan Tran
(74) *Attorney, Agent, or Firm*—Sughrue Mion, PLLC

(57) ABSTRACT

The present invention provides an ink delivery system and an ink delivery method of a liquid-type electrophotographic printer which are adapted to detect whether or not liquid in any one of containers which supply ink and a solvent to circulation tanks is exhausted without installing separate level sensors.

10 Claims, 5 Drawing Sheets

INK DELIVERY SYSTEM AND INK DELIVERY METHOD OF LIQUID -TYPE ELECTROPHOTOGRAPHIC PRINTER

BACKGROUND OF THE INVENTION

1. Field of the Invention

The present invention relates to an ink delivery system of delivering ink used for development in a liquid-type electrophotographic printer, and an ink delivery method thereof.

2. Description of the Related Art

In general, a liquid-type electrophotographic printer is an apparatus in which an electrostatic latent image is formed on a photosensitive medium by scanning the photosensitive medium with a plurality of laser beams, thereafter, the electrostatic latent image is developed with ink and the developed image is transferred onto a paper sheet. The ink used in development is a mixture of a powder toner and a liquid solvent.

FIG. 1 shows a portion of a liquid type electrophotographic printer. As shown in FIG. 1, a liquid type electrophotographic printer includes developing units 20 for developing respective electrostatic latent images with ink having predetermined colors to form a visible image, a drying unit 30 for drying the developed image to an extent appropriate for transferring the developed image onto a paper sheet at a transfer unit (not shown), and an ink delivery system 40 for supplying ink having a concentration and a quantity which are appropriate for development to the developing units 20, and for resupplying the solvent recovered by the drying unit 30 to circulation tanks 45. FIG. 1 shows a conventional liquid-type electrophotographic, color printer. In FIG. 1, only a developing unit corresponding to a black developer is shown, and other developing units corresponding to yellow (Y), magenta (M), and cyan (C) developers are omitted.

Ink used in development is made by mixing concentrated ink supplied from ink tanks 41 and a liquid solvent supplied from a solvent cartridge 44 or a condensing tank 39 connected to the drying unit 30 in a predetermined ratio to dilute the concentrated ink.

The ink delivery system 40 includes ink tanks 41 for storing concentrated ink, a solvent tank 42 for storing a solvent, concentrated ink refill cartridges 43 of pressurized-can-type refill cartridges for refilling the respective ink tanks 41 with respective new supplies of concentrated ink when the concentrated ink in the ink tanks 41 is consumed, a solvent refill cartridge 44 of a pressurized-can-type refill cartridge for refilling the solvent tank 42 with a new supply of a solvent when the solvent in the solvent tank 42 is consumed, circulation tanks 45 for storing appropriately mixed mixtures of ink supplied from the ink tanks 41 and the solvent supplied from the solvent tank 42, supply portions 47 for supplying the ink in the circulation tanks 45 to the developing units 20 and a waste ink tank 49 for temporarily storing ink drained from the circulation tanks 45 through respective waste ink recovery passages 48.

The circulation tanks 45 are installed below the respective developing units 20 and they supply ink to the respective developing units 20. The circulation tanks 45 also circulate, receive and resupply the ink which does not take part in development. Concentration sensors 46 are installed at the respective circulation tanks 45 for sensing respective concentrations of developers contained in the circulation tanks 45.

The ink tanks 41 and the solvent tank 42 store concentrated ink and a solvent supplied from the pressurized-can-type ink cartridges 43 and solvent cartridge 44 which can discharge the contained liquid with pressurized air as described above, and supply the concentrated ink and the solvent to the circulation tanks 45 in predetermined ratios. When any one of the corresponding concentration sensors 46 detects that the concentration of the ink in a corresponding one of the circulation tanks 45 is out of a predetermined range, the corresponding ink tank 41 and the solvent tank 42 supply the concentrated ink and the solvent to the corresponding circulation tank 45 in a controlled manner so that the concentration of the ink in the corresponding circulation tank 45 can be within the desired range. Reference numerals 41*a* and 42*a* denote level sensors for detecting remaining quantities of the ink and the solvent stored in the ink tanks 41 and the solvent tank 42, respectively. When the level sensors 41*a* and 42*a* detect that the ink and the solvent in the tanks 41 and 42 are consumed, the consumed tanks 41 and 42 are refilled with new supplies of the ink and the solvent from the ink cartridges 43 and the solvent cartridge 44.

However, in the above-described ink delivery system, since the concentrated ink and the solvent contained in the ink cartridges 43 and the solvent cartridge 44 are first transferred to the ink tanks 41 and the solvent tank 42 provided with the level sensors 41*a* and 42*a*, respectively, and then supplied to the circulation tanks 45 in order to control ink and solvent supplies and refills in the system, it's disadvantageous that the number of containers installed in a printer is large.

In addition, the above level sensors 41*a* and 42*a* usually employ a level measuring method in which ink levels are measured by detecting varying capacitances of the ink. As a matter of course, there are other level sensors, employing a floater, or an ultrasonic wave, besides the level sensor employing the capacitance measuring method. However, those level sensors are not employed in this application. A floater may malfunction if it adheres to an inner wall of a container, and a level sensor using an ultrasonic wave is very expensive and is too large for this application. Also, in the above capacitance measuring method, the level sensor may respond to ink adhering to the inner wall of a container, and detect an ink level erroneously. Therefore, in order to enhance the operational stability of an ink delivery system, it is desirable that the number of such level sensors is reduced as much as possible.

Consequently, if exhaustion of ink filled in a container can be known without a level sensor, the number of parts can be reduced, possibility of erroneous operations of level sensors can be reduced, and, in addition, the number of containers in an ink delivery system can be reduced since concentrated ink and a solvent need not be transferred to containers having level sensors. Therefore, new types of ink delivery system and ink delivery method are required for realizing the above.

SUMMARY OF THE INVENTION

To solve the above problem, it is an objective of the present invention to provide an ink delivery system and an ink delivery method of a liquid-type electrophotographic printer which are adapted to detect whether or not liquid in any one of containers which supply ink and a solvent to circulation tanks is exhausted without installing separate level sensors.

Accordingly, to achieve the above objective, there is provided an ink delivery method of a liquid-type electrophotographic printer for supplying concentrated ink and a solvent to circulation tanks receiving ink to be supplied to respective developing units including the steps of: (a) preparing ink cartridges which store concentrated ink to be supplied to the circulation tanks; (b) preparing a solvent cartridge which stores a solvent to be supplied to the circulation tanks; (c) detecting an ink concentration of each circulation tank using predetermined concentration sensors which correspond to respective circulation tanks; (d) adjusting the ink concentration of any one of the circulation tanks by supplying the concentrated ink from a corresponding one of the ink cartridges to a corresponding one of the circulation tanks when the ink concentration of the corresponding circulation tank is lower than a predetermined range; (e) generating a message, even after a preset number of the ink concentration adjusting steps are repeated, signaling that the concentrated ink in the corresponding ink cartridge is consumed when the ink concentration is not within the predetermined range; (f) adjusting the ink concentration of any one of the circulation tanks by supplying the solvent from the solvent cartridge to a corresponding one of the circulation tanks when the ink concentration of the corresponding circulation tank is higher than a predetermined range; and (g) generating a message, even after a preset number of the ink concentration adjusting steps are repeated, signaling that the solvent in the solvent cartridge is consumed when the concentration is not within the predetermined range.

According to another aspect of the present invention, there is provided an ink delivery method of a liquid-type electrophotographic printer for supplying concentrated ink and a solvent to circulation tanks receiving ink to be supplied to respective developing units including the steps of: (a) preparing ink cartridges which store concentrated ink to be supplied to the circulation tanks; (b) preparing a solvent cartridge which stores a solvent to be supplied to the circulation tanks, (c) providing a level sensor for detecting a quantity of the solvent remaining in the solvent cartridge; (d) detecting an ink concentration of each circulation tank by using predetermined concentration sensors which correspond to respective circulation tanks; (e) adjusting the ink concentration of any one of the circulation tanks by supplying the concentrated ink from a corresponding one of the ink cartridges to a corresponding one of the circulation tanks when the ink concentration of the corresponding circulation tank is lower than a predetermined range; (f) generating a message, even after a preset number of the ink concentration adjusting steps are repeated, signaling that the concentrated ink in the corresponding ink cartridge is consumed when the concentration is not within the predetermined range; (g) using a corresponding level sensor to determine whether or not the solvent in the solvent cartridge is consumed when the ink concentration of any one of the circulation tanks is higher than a predetermined range; (h) adjusting the ink concentration of a corresponding one of the circulation tanks by supplying the solvent to the corresponding circulation tank when the solvent remains in the solvent cartridge; and (i) generating a message signaling that the solvent in the solvent cartridge is consumed when the solvent in the solvent cartridge is consumed.

In addition, to achieve the above objective, there is provided an ink delivery system of a liquid-type electrophotographic printer including: circulation tanks for receiving ink to be supplied to respective developing units; concentration sensors each for detecting a concentration of ink in the corresponding circulation tank; ink cartridges which store concentrated ink to be supplied to the respective circulation tanks and are directly connected to the respective circulation tanks; and a solvent cartridge which stores a solvent to be supplied to the circulation tanks and is directly connected to the circulation tanks.

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Hereinafter, preferred embodiments of the present invention will be described in detail with reference to the attached drawings.

Figure 1:
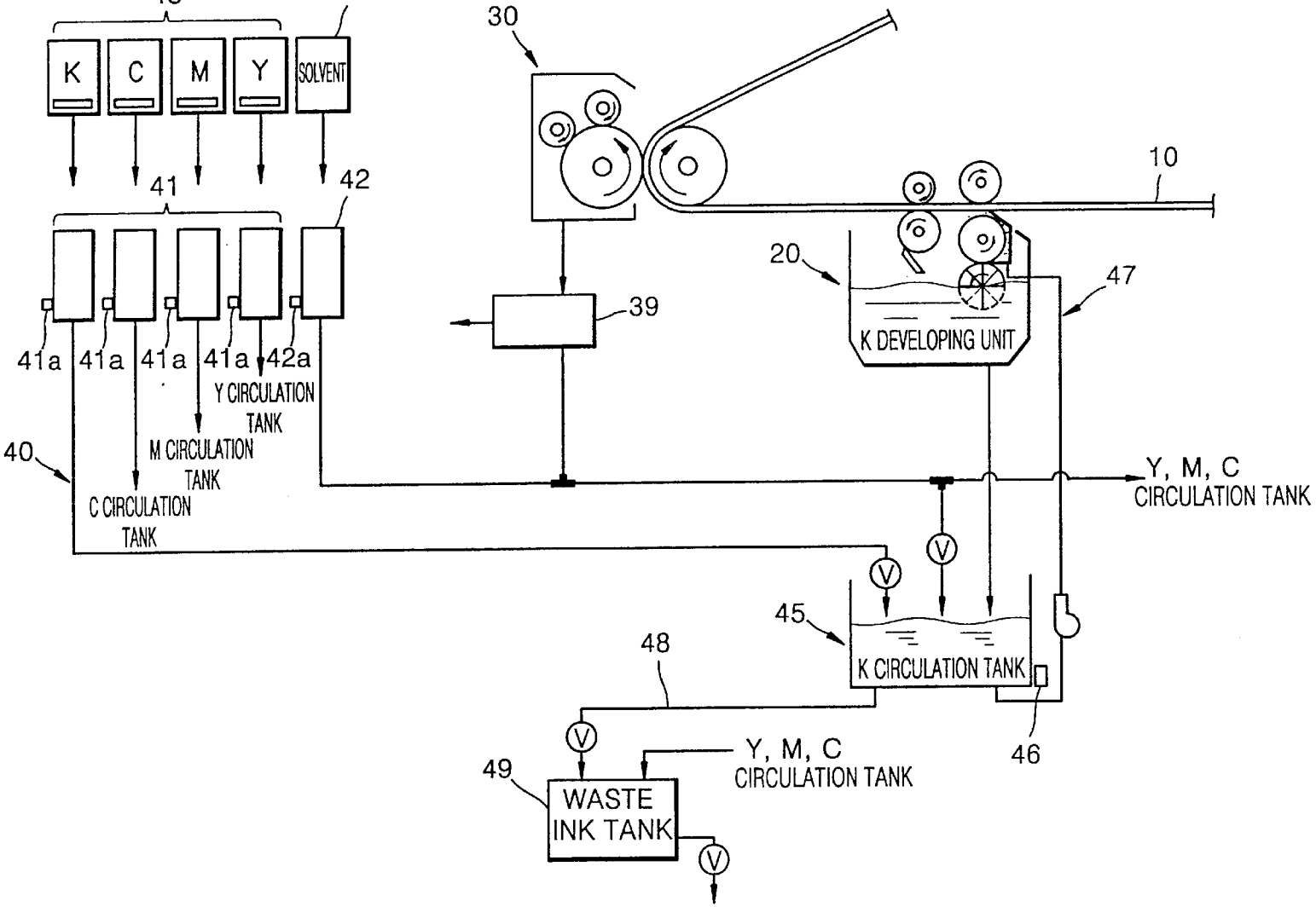
FIG. 1 PRIOR ART
FIG. 1 is a diagram illustrating a conventional ink delivery system of a liquid-type electrophotographic printer.
Figure 2:
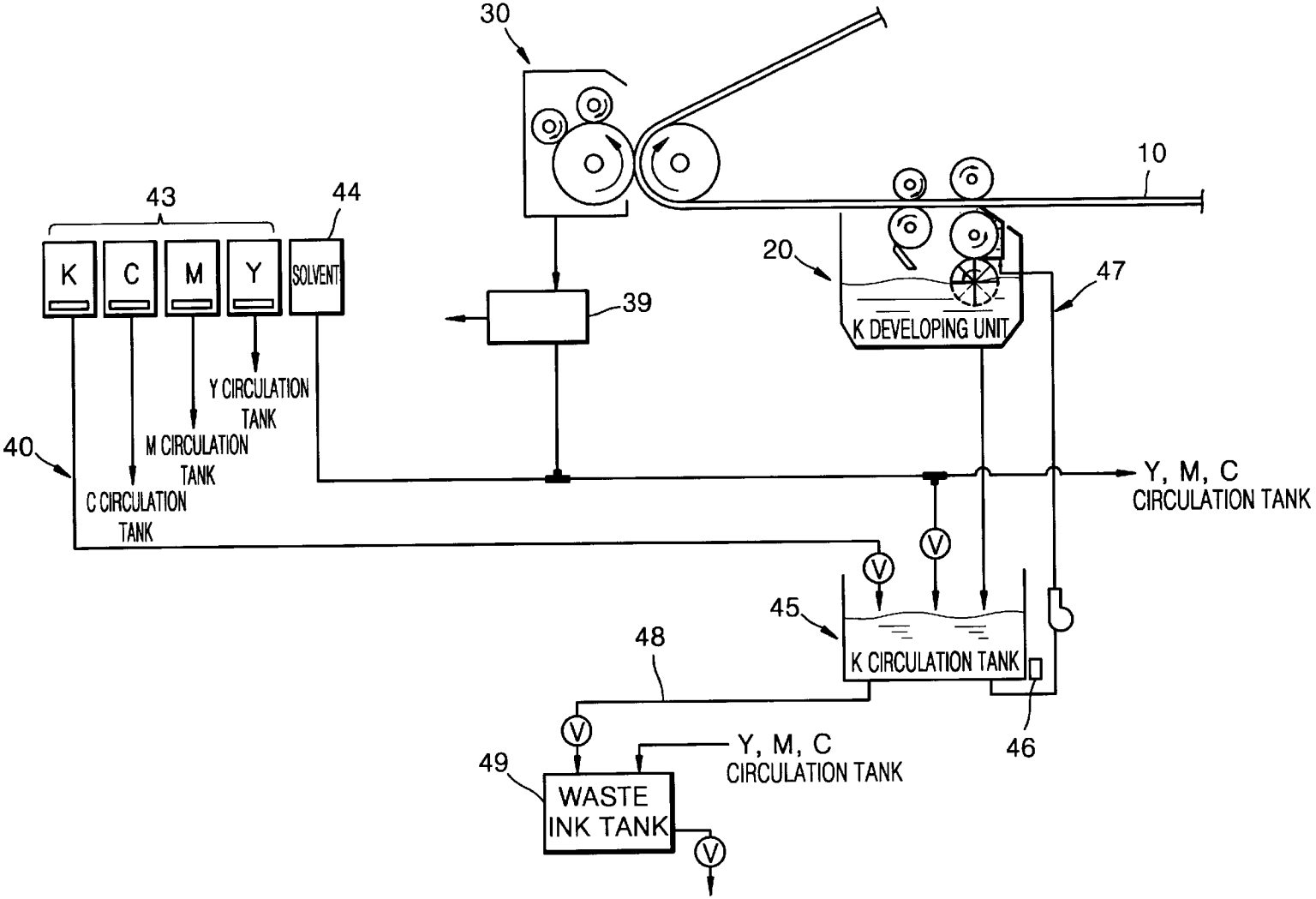
FIG. 2 is a diagram illustrating an ink delivery system for realizing an ink delivery method of a liquid-type electrophotographic printer according to a first embodiment of the present invention.

FIG. 2 is a diagram illustrating an ink delivery system for realizing an ink delivery method of a liquid-type electrophotographic printer according to a first embodiment of the present invention. Here, the same reference numerals used previously to denote members shown in FIG. 1, are used to denote similar members having similar functions.

Referring to FIG. 2, an ink delivery system 40 includes circulation tanks 45, ink cartridges 43 and a solvent cartridge 44 for storing concentrated ink of predetermined colors and a solvent to be supplied to the circulation tanks 45, respectively, and a waste ink tank 49 for recovering waste ink drained from the circulation tanks 45, and concentration sensors 46 installed at the respective circulation tanks 45 for sensing the respective concentrations of the ink contained in the circulation tanks 45.

Differing from the ink delivery system shown in FIG. 1, the ink delivery system of the present invention is characterized in that the separate ink tanks 41 (FIG. 1) and the separate solvent tank 42 (FIG. 1) are not installed, and the refill ink cartridges 43 and the solvent cartridge 44 are directly connected to the circulation tank 45. That is, when comparing the ink delivery system of the present invention with a conventional system, the ink tanks 41 (FIG. 1) and the solvent tanks 42 (FIG. 1) are omitted, and, accordingly, the level sensors 41*a* and 42*a* (FIG. 1) are omitted from the ink delivery system of the present invention. The structure of the ink delivery system can be simplified by the following ink delivery method.

Figure 3:
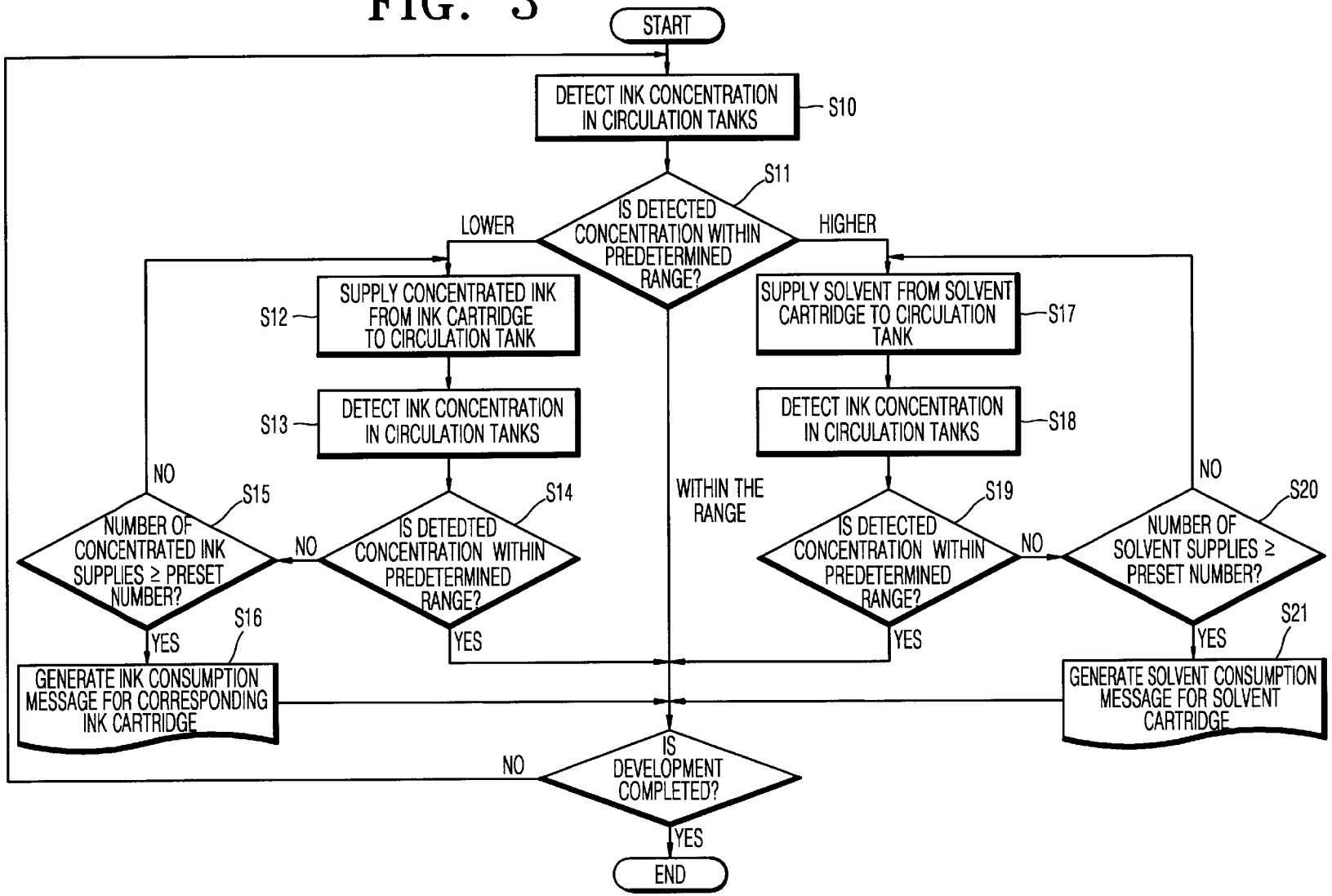
FIG. 3 is a flowchart illustrating the ink delivery method according to the first embodiment of the present invention.

Referring to a flowchart of FIG. 3, while the operation of development proceeds, a concentration of ink used in development is periodically detected by each of the concentration sensors 46 of the circulation tanks 45 (S10). At this time, the detected concentration is compared with a predetermined concentration range (S11). When the detected concentration falls within the predetermined range, the operation of development is continued without an additional supply of the ink or the solvent, and when the detected concentration is lower or higher than the predetermined range, an appropriate quantity of the ink or the solvent is supplied from the corresponding ink cartridge 43 or the solvent cartridge 44 to the corresponding circulation tank 45.

When the detected concentration is lower than the predetermined range, an appropriate quantity of the concentrated ink is supplied from the ink cartridge 43 to the circulation tank 45 in order to heighten the concentration to a value within the predetermined range (S12). Then, the concentration of the ink in the circulation tank 45 is detected by the concentration sensor 46 (S13), and whether or not the concentration is within the predetermined range is determined (S14). At this time, when the concentration of the ink is within the predetermined range, the ink supply is finished. When the concentration of the ink is not within the predetermined range, the ink supply from the ink cartridge 43 is repeated. In addition, it is determined whether or not the ink supply operations have been repeated more than a preset number of times (for example 3 times) (S15). Even if the ink supply operations have been repeated more than the preset number of times, when the concentration is not within the predetermined range, it is determined that the ink in the ink cartridge 43 is completely consumed. A message is then generated informing a user that the ink in the ink cartridge 43 has been consumed (S16). Therefore, when the message is generated, the ink cartridge 43 is replaced with a new one.

On the other hand, when the detected concentration is higher than the predetermined range, an appropriate quantity of the solvent is supplied from the solvent cartridge 44 to the circulation tank 45 in order to lower the concentration to a value within the predetermined range (S17). Then, the concentration of ink in the circulation tank 45 is detected by the concentration sensor 46 (S18), and whether or not the concentration is within the predetermined range is determined (S19). At this time, when the concentration of the ink is within the predetermined range, the solvent supply is finished. When the concentration of the ink is not within the predetermined range, the solvent supply from the solvent cartridge 44 is repeated. In addition, it is determined whether or not the solvent supply operations have been repeated more than a preset number of times (for example 3 times) (S20). Even if the solvent supply operations have been repeated more than the preset number, when the concentration is not within the predetermined range it is determined that the solvent in the solvent cartridge 44 is completely consumed. A message is then generated informing a user that the solvent in the solvent cartridge 44 is consumed (S21). Therefore, when the message is generated, the solvent cartridge 44 is replaced with a new one.

According to the first embodiment of the ink delivery system and the ink delivery method, whether or not the ink cartridges 43 and the solvent cartridge 44 are consumed is determined by whether or not the concentration of ink in the circulation tank 45 varies with the ink and solvent supply operations. Separate ink tanks and a separate solvent tank, which are provided with respective level sensors, do not have to be installed in the ink delivery system. Accordingly, the ink delivery system can be simple.

Figure 4:
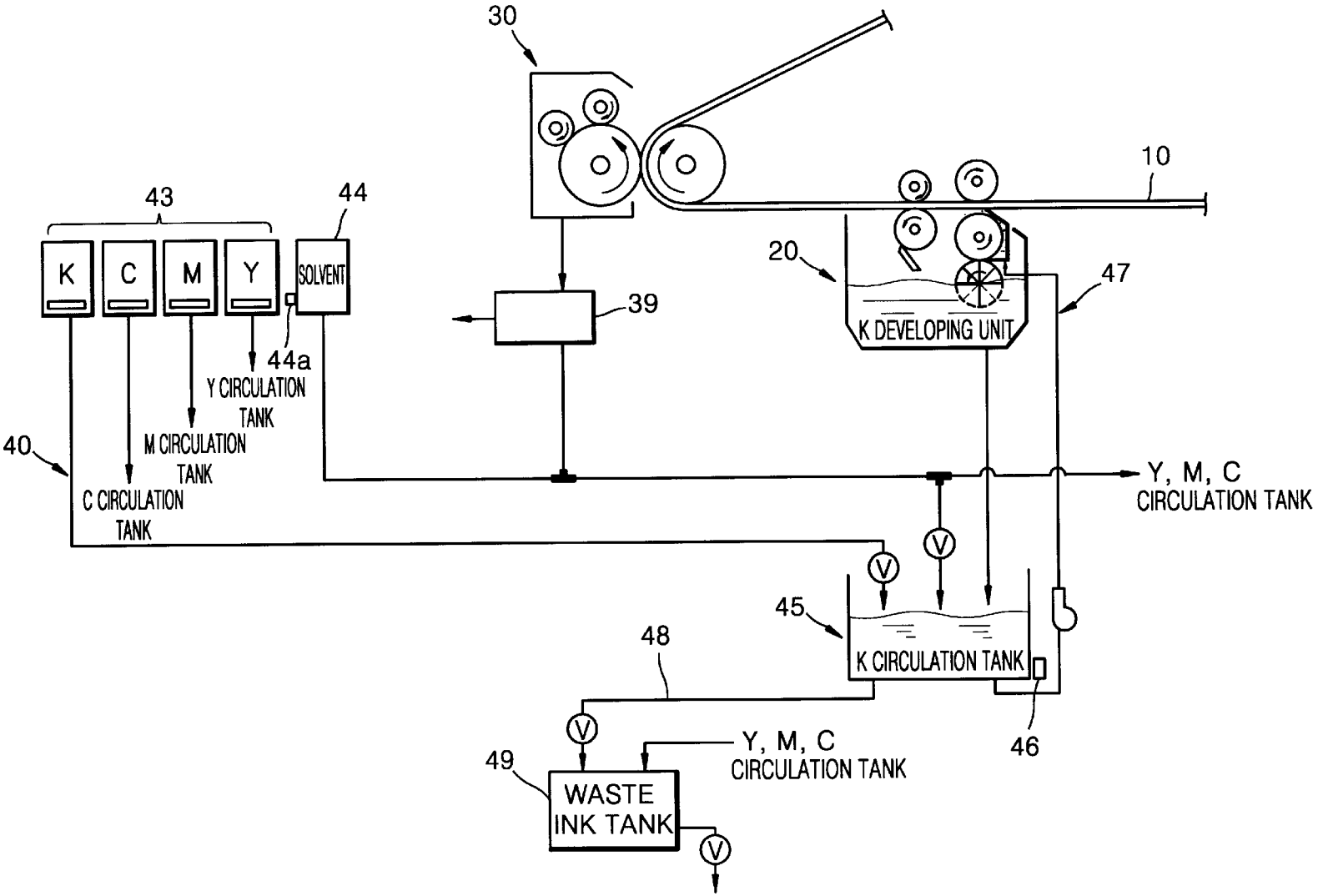
FIG. 4 is a diagram illustrating an ink delivery system for realizing an ink delivery method of a liquid-type electrophotographic printer according to a second embodiment of the present invention.
Figure 5:
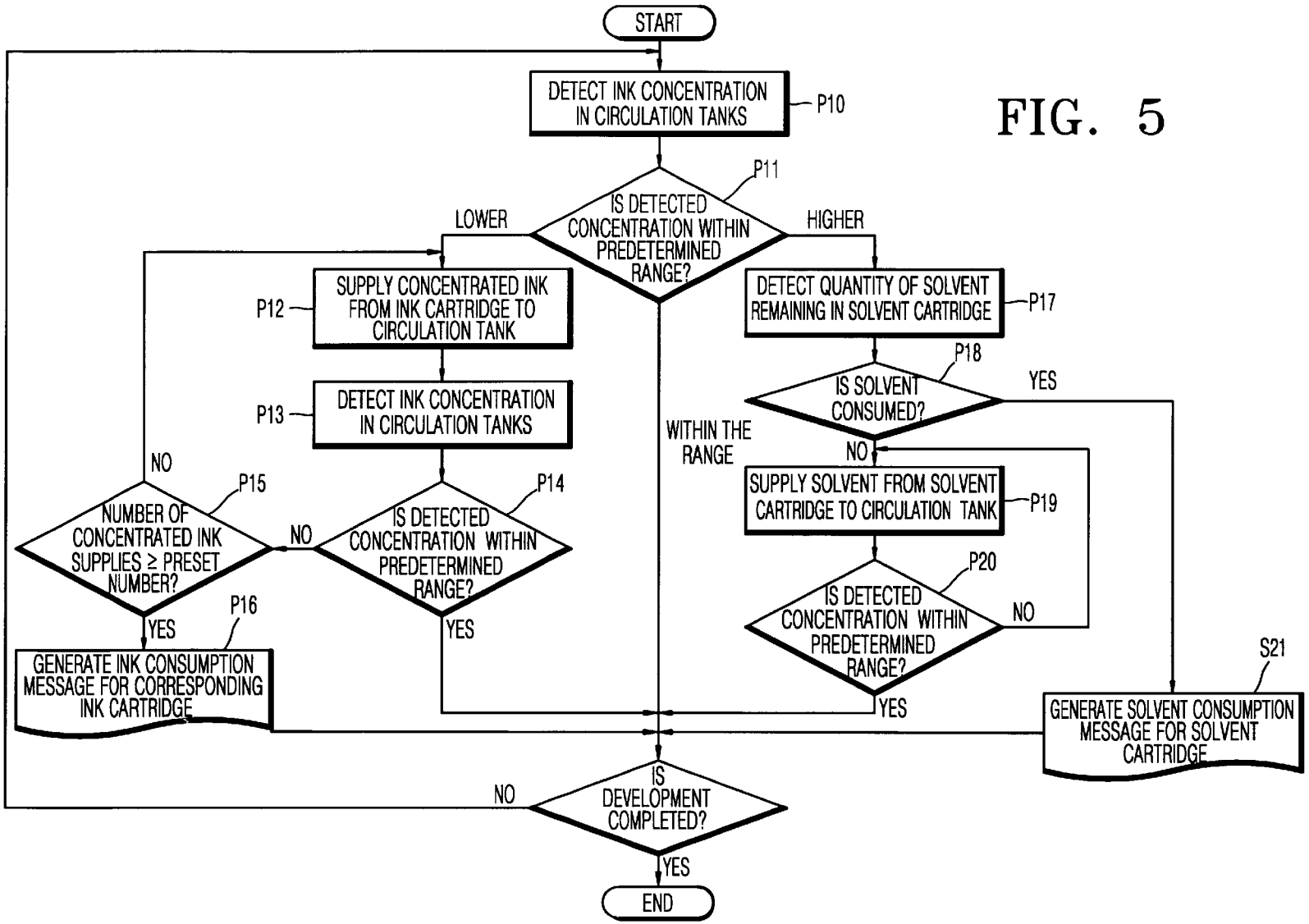
FIG. 5 is a flowchart illustrating the ink delivery method according to the second embodiment of the present invention.

Next, FIGS. 4 and 5 show a diagram and a flowchart respectively illustrating a structure of an ink delivery system and an ink delivery method according to a second embodiment of the present invention.

The structure of the second embodiment is nearly similar to that of the above-described first embodiment except that a level sensor 44*a* is installed at a solvent cartridge 44.

In the first embodiment, since whether or not the ink or solvent is consumed is determined after the preset number of the ink or solvent supply operations when the concentration of the ink in the circulation tank 45 is adjusted, it takes so much time until an ink or solvent consumption message is generated. However, the solvent cartridge 44 is commonly used for supplying the solvent to all the circulation tanks 45. Even though one level sensor, i.e., the level sensor 44*a* is installed at the solvent cartridge 44, the ink delivery system does not become so complex, and then whether or not the solvent in the solvent cartridge 44 is consumed can be detected by the level sensor 44*a* immediately. Therefore, this embodiment realizes a system capable of making the system simple and detecting the solvent consumption immediately.

In an ink delivery system having the above-described configuration, while the operation of development proceeds, a concentration of the ink in each of the circulation tanks 45 is periodically detected by each of the concentration sensors 46 of the circulation tanks 45 (P10). At this time, the detected concentration is compared with a predetermined concentration range (P11). When the detected concentration falls within the predetermined range, the operation of development is continued without an additional supply of the solvent.

When the detected concentration is lower than the predetermined range, the same procedure as in the above-described first embodiment is performed, that is, an appropriate quantity of the concentrated ink is supplied from the ink cartridge 43 to the circulation tank 45 in order to heighten the concentration to a value within the predetermined range (P12). Then, the concentration of the ink in the circulation tank 45 is detected by the concentration sensor 46 (P13), and whether or not the concentration is within the predetermined range is determined (P14). At this time, when the concentration of the ink is within the predetermined range, the ink supply is finished. When the concentration of the ink is not within the predetermined range, the ink supply from the ink cartridge 43 is repeated. In addition, it is determined whether or not the ink supply operations have been repeated more than a preset number of times (for example 3 times) (P15). Even if the ink supply operations are repeated more than the preset number of times, when the concentration is not within the predetermined range it is determined that the ink in the ink cartridge 43 is completely consumed. A message is then generated informing a user that the ink in the ink cartridge 43 is consumed (P16). Therefore, when the message is generated, the ink cartridge 43 is replaced with a new one.

On the other hand, when the detected concentration is higher than the predetermined range, whether or not the solvent to be supplied to the circulation tank 45 remains in the solvent cartridge is detected by the level sensor (P17), and whether or not the solvent is consumed is determined (P18). At this time, when the solvent in the solvent cartridge is consumed, a solvent consumption message is generated immediately (P21). Therefore, when the message is generated, the solvent cartridge 44 is replaced with a new one. To the contrary, when the solvent exists in the solvent cartridge 44, the solvent is supplied to the circulation tank 45 (P19) while it is determined whether or not the concentration of the ink in the circulation tank 45 falls within the predetermined range (P20).

As a result, compared with a conventional system, this embodiment is capable of reducing the numbers of the level sensors and the containers, and detecting whether or not the solvent in the solvent cartridge 44 is consumed immediately.

As described above, with the ink delivery system and the ink delivery method of a liquid-type electrophotographic printer according to the present invention, the liquid in the ink cartridges and the solvent cartridge can be determined by whether or not the concentration of the ink in each circulation tank varies with the liquid supply operations. Accordingly, level sensors and ink tanks can be omitted, the structure of a printer can be simple, and the ink delivery system can be more stabilized by reducing the number of level sensors having a relatively high possibility of malfunction.

What is claimed is:

1. An ink delivery method of a liquid-type electrophotographic printer for supplying concentrated ink and a solvent to circulation tanks receiving ink to be supplied to respective developing units, comprising:

(a) preparing ink cartridges storing concentrated ink to be supplied to the circulation tanks;

(b) preparing a solvent cartridge storing a solvent to be supplied to the circulation tanks;

(c) detecting an ink concentration of each circulation tank by using predetermined concentration sensors which correspond to respective circulation tanks;

(d) adjusting the ink concentration of any one of the circulation tanks by supplying the concentrated ink from a corresponding one of the ink cartridges directly to a corresponding one of the circulation tanks when the ink concentration of the corresponding circulation tank is lower than a predetermined range;

(e) generating a message informing that the concentrated ink in the corresponding ink cartridge is consumed when the concentration is not within the predetermined range, even after a preset number of the ink concentration adjusting steps have been repeated;

(f) adjusting the ink concentration of any one of the circulation tanks by supplying the solvent from the solvent cartridge directly to a corresponding one of the circulation tanks when the ink concentration of the corresponding circulation tank is higher than a predetermined range; and (g) generating a message informing that the solvent in the solvent cartridge is consumed when the concentration is not within the predetermined range, even after a preset number of the ink concentration adjusting steps have been repeated.

2. An ink delivery method of a liquid-type electrophotographic printer for supplying concentrated ink and a solvent to circulation tanks receiving ink to be supplied to respective developing units, comprising:

(a) preparing ink cartridges storing concentrated ink to be supplied to the circulation tanks;

(b) preparing a solvent cartridge storing a solvent to be supplied to the circulation tanks;

(c) providing a level sensor for detecting a quantity of the solvent remaining in the solvent cartridge;

(d) detecting an ink concentration of each circulation tank by using predetermined concentration sensors which correspond to respective circulation tanks;

(e) adjusting the ink concentration of any one of the circulation tanks by supplying the concentrated ink from a corresponding one of the ink cartridges directly to a corresponding one of the circulation tanks when the ink concentration of the corresponding circulation tank is lower than a predetermined range;

(f) generating a message informing that the concentrated ink in the corresponding ink cartridge is consumed when the concentration is not within the predetermined range even after a preset number of the ink concentration adjusting steps have been repeated;

(g) determining whether or not the solvent in the solvent cartridge is consumed when the ink concentration of any one of the circulation tanks is higher than a predetermined range, (h) adjusting the ink concentration of a corresponding one of the circulation tanks by supplying the solvent directly to the corresponding circulation tank when the solvent remains in the solvent cartridge; and (i) generating a message informing that the solvent in the solvent cartridge is consumed when the solvent in the solvent cartridge is consumed.

3. The method of claim 2, wherein in step (g), the level sensor determines whether or not the solvent in the solvent cartridge is consumed.

4. An ink delivery system of a liquid-type electrophotographic printer including:

circulation tanks for receiving ink to be supplied to respective developing units;

concentration sensors each for detecting a concentration of ink in a corresponding circulation tank;

ink cartridges which store concentrated ink to be supplied to the respective circulation tanks and are directly connected to the respective circulation tanks; and a solvent cartridge which stores a solvent to be supplied to the respective circulation tanks and is directly connected to the respective circulation tanks.

5. An ink delivery system of a liquid-type electrophotographic printer as claimed in claim 4, wherein a level sensor is installed at the solvent cartridge for detecting a quantity of the solvent remaining in the solvent cartridge.

6. An ink delivery method of a liquid-type electrophotographic printer for supplying concentrated ink and a solvent to circulation tanks receiving ink to be supplied to respective developing units, said method comprising:

(a) providing ink cartridges operable to store concentrated ink to be supplied directly to the circulation tanks;

(b) providing a solvent cartridge operable to store a solvent to be supplied directly to the circulation tanks;

(c) providing predetermined concentration sensors operable to detect an ink concentration of each circulation tank;

(d) increasing the amount of concentrated ink in any one of the circulation tanks when the ink concentration of one of the circulation tanks is lower than a predetermined range;

(e) generating a message informing that the concentrated ink in a corresponding one of the ink cartridges is consumed;

(f) increasing the amount of solvent in any one of the circulation tanks when the ink concentration of one of the circulation tanks is higher than a predetermined range; and (g) generating a message informing that the solvent in the solvent cartridge is consumed.

7. The method of claim 6, wherein in step (c), the predetermined concentration sensors correspond to respective circulation tanks.

8. An ink delivery method of a liquid-type electrophotographic printer for supplying concentrated ink and a solvent to circulation tanks receiving ink to be supplied to respective developing units, said method comprising:

(a) providing ink cartridges operable to store concentrated ink to be supplied directly to the circulation tanks;

(b) providing a solvent cartridge operable to store a solvent to be supplied directly to the circulation tanks (c) providing a level sensor for detecting a quantity of the solvent remaining in the solvent cartridge;

(d) providing predetermined concentration sensors operable to detect an ink concentration of each circulation tank;

(e) increasing the amount of concentrated ink in any one of the circulation tanks when the ink concentration of one of the circulation tanks is lower than a predetermined range;

(f) generating a message informing that the concentrated ink in a corresponding one of the ink cartridges is consumed when the concentration is not within the predetermined range;

(g) determining whether or not the solvent in the solvent cartridge is consumed when the ink concentration of any one of the circulation tanks is higher than a predetermined range;

(h) increasing the amount of solvent in any one of the circulation tanks when the solvent remains in the solvent cartridge; and (i) generating a message informing that the solvent in the solvent cartridge is consumed when the solvent in the solvent cartridge is consumed.

9. The method of claim 8, wherein in step (g), whether or not the solvent in the solvent cartridge is consumed when the ink concentration of any one of the circulation tanks is higher than a predetermined range is determined by the level sensor.

10. An ink delivery method of a liquid-type electrophotographic printer for supplying concentrated ink and a solvent to circulation tanks receiving ink to be supplied to respective developing units, comprising:

(a) preparing ink cartridges storing concentrated ink to be supplied to the circulation tanks;

(b) preparing a solvent cartridge storing a solvent to be supplied to the circulation tanks;

(c) detecting an ink concentration of each circulation tank by using predetermined concentration sensors which correspond to respective circulation tanks;

(d) adjusting the ink concentration of any one of the circulation tanks by directly supplying the concentrated ink from a corresponding one of the ink cartridges to a corresponding one of the circulation tanks when the ink concentration of the corresponding circulation tank is lower than a predetermined range;

(e) generating a message informing that the concentrated ink in the corresponding ink cartridge is consumed when the concentration is not within the predetermined range, even after a preset number of the ink concentration adjusting steps have been repeated;

(f) adjusting the ink concentration of any one of the circulation tanks by supplying the solvent directly from the solvent cartridge to a corresponding one of the circulation tanks without commingling the solvent and the concentrated ink outside the corresponding one of the circulation tanks when the ink concentration of the corresponding circulation tank is higher than a predetermined range; and (g) generating a message informing that the solvent in the solvent cartridge is consumed when the concentration is not within the predetermined range, even after a preset number of the ink concentration adjusting steps have been repeated.

* * * * *